US006505659B1

(12) United States Patent
Hummel

(10) Patent No.: US 6,505,659 B1
(45) Date of Patent: Jan. 14, 2003

(54) TOOL SUPPORT

(76) Inventor: Richard M. Hummel, 8318 Manorford Dr., Parma, OH (US) 44129

( * ) Notice: Subject to any disclaimer, the term of this patent is extended or adjusted under 35 U.S.C. 154(b) by 0 days.

(21) Appl. No.: 10/101,801

(22) Filed: Mar. 20, 2002

(51) Int. Cl.[7] ..... B27C 5/00

(52) U.S. Cl. ..... 144/135.2; 74/22 A; 74/25; 144/48.6; 144/137; 144/136.95; 409/185; 409/218

(58) Field of Search ..... 144/48.6, 134.1, 144/136.95, 135.2, 137, 154.5, 145.2, 145.3, 371, 136.1; 74/22 A, 25, 26, 27, 841; 409/185, 218, 180, 181, 182

(56) References Cited

U.S. PATENT DOCUMENTS 3,710,833 A * 1/1973 Hammer et al. ..... 144/135.2
4,454,898 A * 6/1984 Paunica ..... 144/48.6
4,456,042 A * 6/1984 Clark et al. ..... 144/117.1
4,537,234 A * 8/1985 Onsurd ..... 144/135.2
5,139,061 A * 8/1992 Neilson ..... 144/135.2
5,725,036 A * 3/1998 Walter ..... 144/135.2
5,772,368 A * 6/1998 Posh ..... 144/136.95
6,374,878 B1 * 4/2002 Mastley et al. ..... 144/48.6

FOREIGN PATENT DOCUMENTS

CA 2314653 1/2001

* cited by examiner

*Primary Examiner*—W. Donald Bray
(74) *Attorney, Agent, or Firm*—Fay, Sharpe, Fagan, Minnich & McKee

(57) ABSTRACT

A support mechanism for a router comprises a plate having top and bottom sides and an opening therethrough, and a carriage supported in suspension beneath the plate for supporting a router coaxial with the opening. A pair of guide posts slidably support the carriage for axial displacement toward and away from the plate, and a pair of adjusting screws which are rotatable relative to said plate interengage with the carriage for rotation of the screws to displace said carriage relative to the plate. Each of said guide posts has a post axis and each of the adjusting screws has a screw axis, the axes of the posts, and adjusting screws are coplanar with one another and with the opening axis. The adjusting screws are rotated simultaneously by a sprocket wheel and sprocket chain drive train on the bottom side of the plate.

52 Claims, 5 Drawing Sheets

TOOL SUPPORT

BACKGROUND OF THE INVENTION

This invention relates to the art of tools and, more particularly, to an improved mechanism for supporting a woodworking tool beneath a work supporting surface for adjustment of the position of the tool bit or cutter relative to the work supporting surface.

The present invention finds particular utility in connection with the support of a fixed base router relative to a work supporting surface and, accordingly, will be illustrated and described in detail herein in connection with such a router. At the same time, however, it will be appreciated that the invention is applicable to the support of other tools of the character wherein a driven bit, cutter, blade, or the like is supported for vertical adjustment relative to a work supporting surface such as a workbench or table.

It is known, as shown for example in Canadian patent application 2,314,653 in the name of Darrin E. Smith to support a fixed base router beneath a work supporting surface such that the router and thus a router bit to be driven thereby is vertically adjustable relative to the work supporting surface. The adjustability provides for accommodating a wide variety of router bit profiles and, as is well known, such routers are used by woodworkers in connection with the production of furniture, decorative moldings, picture framing strips, and, in connection with the joining of wood pieces, the forming of dovetail joints, box joints and the like. High quality work in connection with the use of routers for the latter and other purposes requires not only a good router, sharp bits, good wood, and a skilled operator but also, precision with respect to obtaining and maintaining a truly perpendicular orientation of the router axis and thus the router bit axis with the plane of the work supporting surface. Further, high quality work requires stability against vibration during a cutting operation, and the ability to accurately and minutely control adjustment of the vertical position of the router bit relative to the work supporting surface.

The desired vertical orientation between the router bit axis and work supporting surface is affected by such factors as the degree of precision in machining the component parts of the router support mechanism and/or the manner in which the router is supported relative to the work supporting surface. With regard to the latter in particular, obtaining and maintaining a precise vertical orientation between the router bit axis and the work supporting surface in the Darrin apparatus is difficult, at best, because the router and the router carriage are supported relative to the work supporting surface by a pair of posts which are laterally offset from the axis of the router and thus the router bit, whereby the router and carriage are supported in cantilever fashion relative to the work supporting surface. Accordingly, the weight of the router and carriage can result in skewing of the router bit axis relative to the desired vertical disposition thereof relative to the work supporting surface. Moreover, the cantilevered support of the router and carriage relative to the guide rods imposes undue wear between the rods and the carriage in response to adjusting the vertical position of the carriage relative to the work supporting surface, and such wear can result in a loss of the desired vertical orientation, even if initially obtained, or a worsening thereof if not initially obtained. Still further, the imposition of a load against the router bit during a woodworking operation can impose a load on the router and carriage which, because of the offset relationship between the router axis and support rods further affects the ability to obtain and/or maintain the desired vertical orientation between the router bit axis and work supporting surface during the woodworking operation.

Vibration of the router and router bit during non-loaded operation of the router can result from a lack of precision in machining the component parts of the router support and, even if not present during non-loaded operation, can occur during a woodworking operation as a result of side thrust against the router bit, especially if a support of the router is laterally offset from the axis thereof as in the Darrin apparatus. With further regard to the latter, a lift or adjusting screw by which the carriage and thus the router bit is vertically displaceable relative to the work supporting surface is also laterally offset from the axis of the router and is threadedly interengaged with the carriage for rotation of the screw to displace the latter and the router relative to the work supporting surface. Accordingly, the adjusting screw is also subjected to the imposition of forces resulting from the cantilever support of the carriage and router which promote undue wear between the interengaging threads on the screw and carriage. Ultimately, such wear results in a decrease in the ability to accurately and, or, minutely adjust the position of the carriage and thus the router bit relative to the work supporting surface.

SUMMARY OF THE INVENTION

In accordance with the present invention, a support mechanism is provided for a router by which the foregoing and other problems and disadvantages encountered in connection with such mechanisms heretofore provided are advantageously avoided or overcome. More particularly in this respect, a router support in accordance with the present invention advantageously provides for supporting the router and router carriage in balanced suspension beneath the work supporting surface and relative to the router axis and thus the router bit axis. The balanced suspension promotes the ability to obtain and maintain the desired perpendicular orientation between a router bit axis and the work supporting surface, both prior to and during a woodworking operation. Still further, the balanced suspension includes a balanced lift or adjusting screw arrangement by which the carriage and thus the router bit is elevated and lowered relative to the work supporting surface. This advantageously provides for maintaining the desired vertical orientation of the router bit relative to the work supporting surface and promotes the ability to accurately adjust the carriage and thus the router bit height relative to the work supporting surface. Moreover, these advantages are obtained and maintainable throughout the life of the apparatus.

In accordance with one aspect of the invention, the support arrangement includes a pair of support and guide posts for the router carriage on diametrically opposite sides of the router axis, and a pair of lift or adjusting screws on diametrically opposite sides of the latter axis and threadedly interegaging with the carriage for rotation of the screws to displace the latter relative to the work supporting surface. The diametrically opposed relationship between the posts and between the adjusting screws balances the support of the carriage and stabilizes the carriage and thus the router supported thereby relative to the work supporting surface. Thus, the imposition of unbalanced forces on the support mechanism during an adjusting operating and/or during wood working operation is avoided or minimized, thus improving precision of cutting and the ability to repetitively obtain such precision.

In accordance with another aspect of the invention, the lift screws have an end exposed at the work supporting surface and provided with scale plates which can be set relative to a corresponding reference mark on the support surface so as to provide improved accuracy in connection with adjusting the height of a router bit relative to the work supporting surface. In accordance with a further aspect of the invention, the carriage comprises a body portion having an arcuate recess and a clamp plate having an arcuate surface which, together with the arcuate recess, provides an opening for surrounding the housing of a router, thus to firmly support the latter on the carriage with equal radial holding forces about the periphery of the housing. Further, through the use of split collars, the carriage is advantageously adapted to support a number of routers having different housing diameters.

It is accordingly an outstanding object of the present invention to provide an improved support mechanism for supporting a router relative to a work supporting surface in a manner which promotes obtaining and maintaining a desired perpendicular orientation between a router and router bit axis and the work supporting surface.

Another object is the provision of a support mechanism of the foregoing character which promotes stability of the router and router bit against vibration during both loaded and non-loaded operation of the router.

A further object is the provision of a support mechanism of the foregoing character which eliminates or minimizes the imposition of unbalanced forces on the support mechanism.

Yet another object is the provision of a support mechanism of the foregoing character which provides an improved ability to accurately and minutely control adjustment of the position of a router bit relative to the work supporting surface.

Still another object is the provision of a support mechanism of the foregoing character in which the router and router carriage are supported in balanced suspension beneath the work supported surface so as to promote a uniform distribution of forces through the support mechanism during a woodworking operation and a uniform application of forces between the component parts of the support mechanism during use of the router and during adjustment of the position of the carriage relative to the work supporting surface.

Yet another object is the provision of a support mechanism of the foregoing character having an improved carriage structure for supporting routers having different housing diameters.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF A PREFERRED EMBODIMENT

Figure 1:
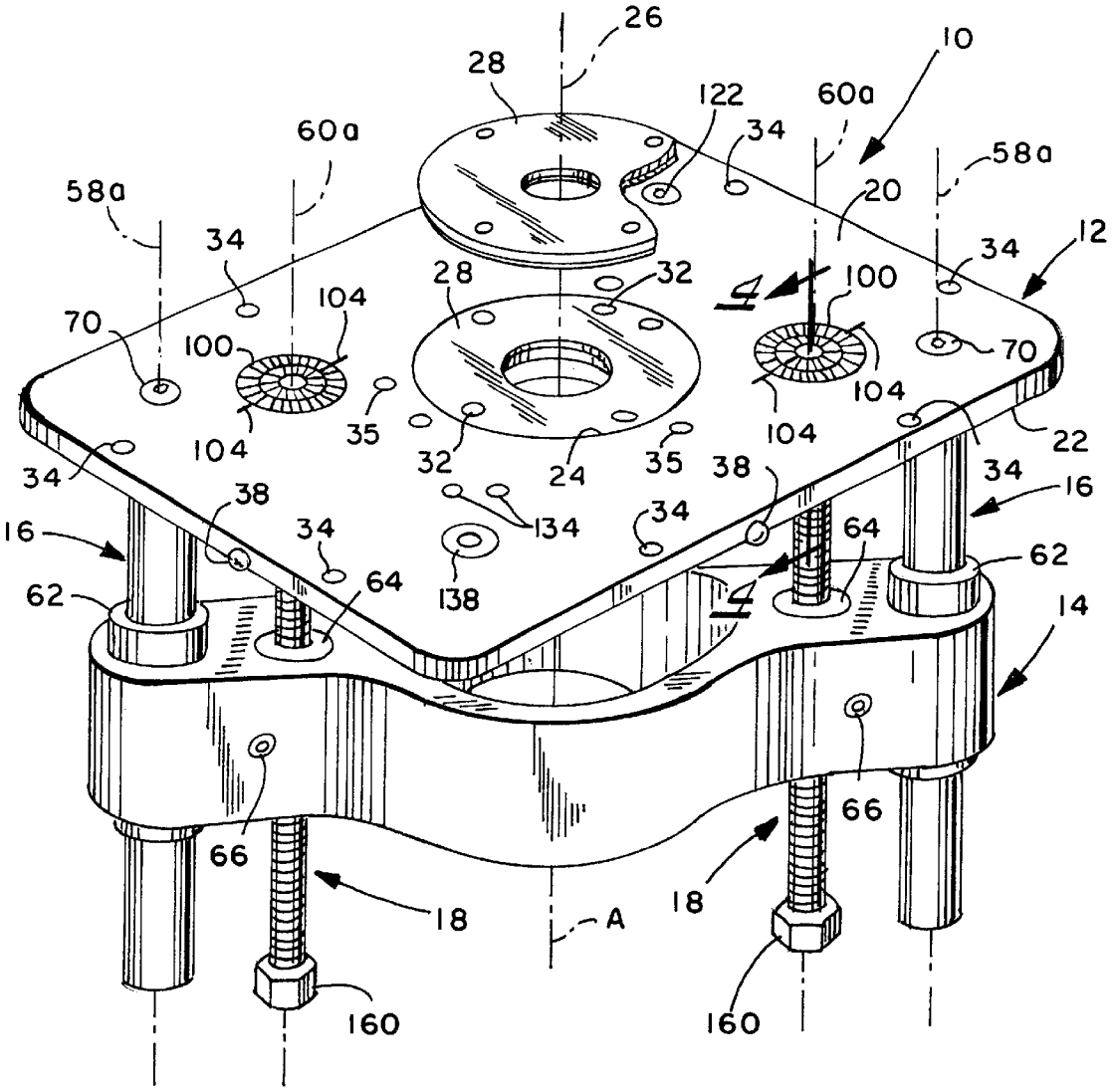
FIG. 1 is a perspective view of a router support mechanism in accordance with the present invention.

Referring now in greater detail to the drawings, wherein the showings are for the purpose of illustrating a preferred embodiment of the invention only, and not for the purpose of limiting the invention, a router support mechanism 10 in accordance with the invention is shown as comprising a table plate component 12 and a carriage component 14 mounted in suspension beneath plate 12, as set forth more fully hereinafter, by a pair of support and guide posts 16 and a pair of lift or adjusting screw units 18. In the disclosed embodiment, table plate 12 is adapted to be inserted into an opening therefor in the top of a router table, but it will be appreciated that the support mechanism according to the invention could be incorporated as an integral part of a router table with the component parts suspended beneath the table top as opposed to an insert plate. Preferably, plate 12 is of cast aluminum and has top and bottom sides 20 and 22, respectively, and an opening 24 therethrough having an axis 26. Opening 24 is adapted to receive any one of a plurality of removable ring members 28 having twist-lock components about the outer periphery thereof for interengagement with twist-lock components 30 spaced apart about the periphery of opening 24. Each of the rings 28 has a different size opening therethrough coaxial with axis 26 for accommodating a particular router bit, and the rings are provided with diametrically opposed openings 32 therethrough for accommodating a spanner wrench by which the ring is mounted and removed from the table plate. Bottom side 22 of plate 12 is provided with a circular collar 33 secured thereto by a plurality of threaded fasteners 35 extending through openings therefor from top side 20 of plate 12. Collar 33 helps with the initial alignment of a router during mounting thereof on carriage 14 and also serves as a guard against the impingement of sawdust and the like falling through the opening in the plate laterally outwardly against the drive components by which the carriage is displaced relative to plate 12 as described more fully hereinafter. The peripheral edge of plate 12 is provided with a plurality of openings 34 therethrough for receiving threaded fasteners by which the plate is leveled relative to a tabletop and, preferably, any two adjacent sides of plate 12 are provided with spring biased ball detent inserts 36 which include a spring-biased ball member 38 projecting outwardly of the side of the plate for engagement in the opening in the router table to stabilize the table plate against side play.

Figure 2:
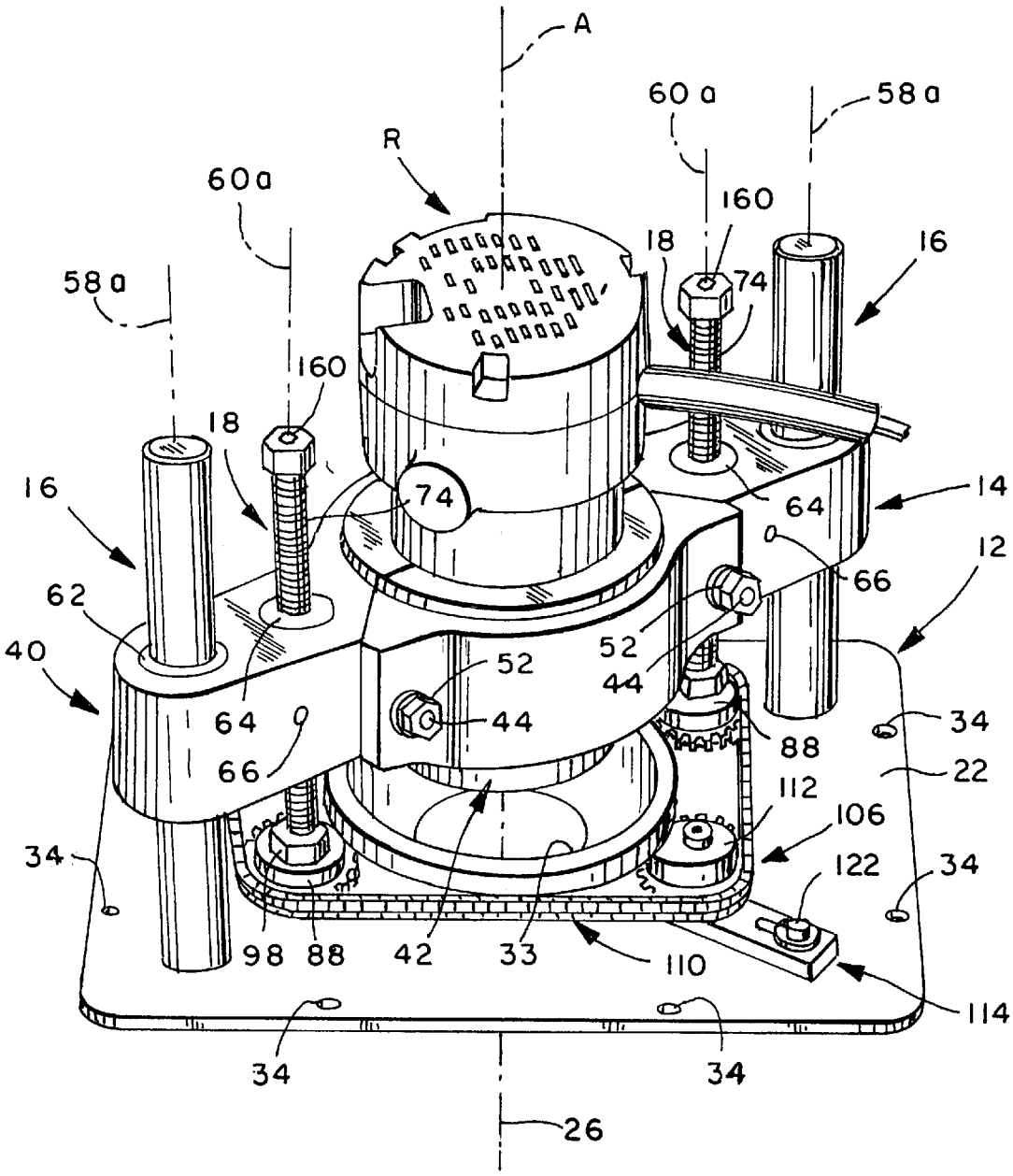
FIG. 2 is a perspective view of the support mechanism shown in FIG. 1, turned upside down and showing a router mounted on the carriage.
Figure 7:
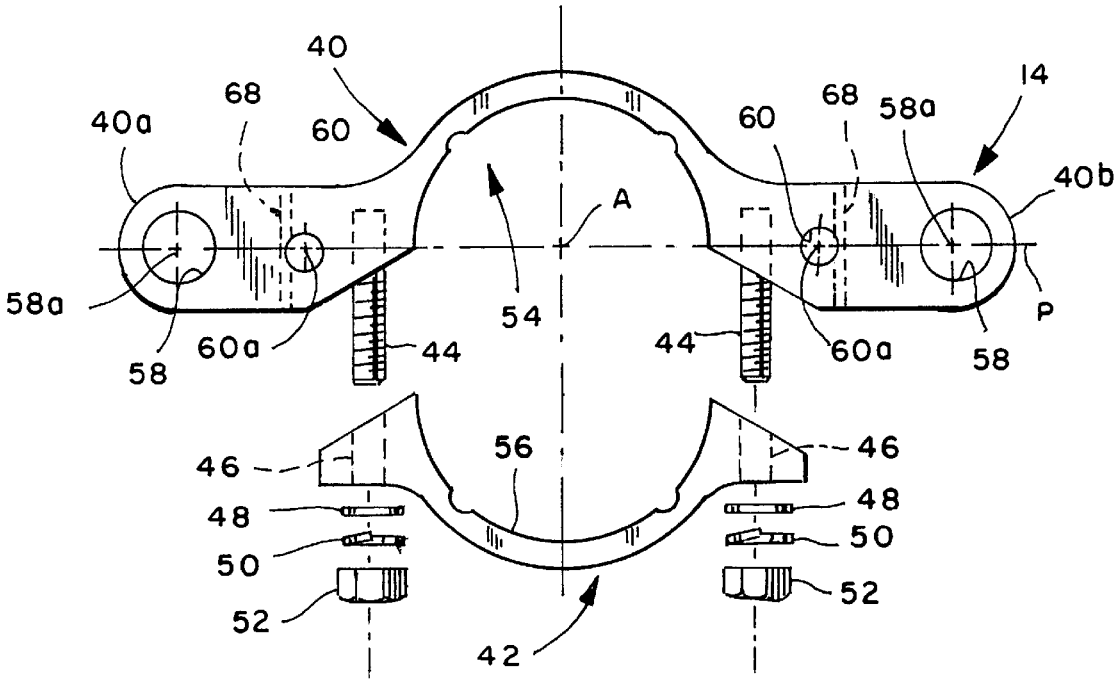

As best seen in FIGS. 2 and 7, carriage 14 comprises a body portion 40 having opposite ends 40*a* and 40*b*, and a clamping plate 42. Plate 42 is adapted to be removably secured to body portion 40 by a pair of threaded studs 44 mounted on the body portion and extending through corresponding openings 46 in the clamping ring, corresponding washers 48, lock washers 50, and nuts 52. Body portion 40 includes an arcuate, semi-circular recess 54 and clamping plate 42 includes an arcuate, semi-circular surface 56. When the clamping plate is mounted on the body portion, recess 54 and surface 56 cooperatively provide a circular opening through the carriage having an axis A which, when the carriage is mounted on plate 12, is coaxial with axis 26 of opening 24. As will be appreciated from FIG. 2, the arcuate surface portions of the recess and clamping ring are adapted to engage about the housing of a router R so as to clampingly mount the router in the carriage with the router axis coaxial with axis A of the carriage and axis 26 of the opening in table plate 12. It will be appreciated that split adapter collars can be interposed between recess 54 and surface 56 in the carriage for clamping routers having housing diameters smaller than that of router R. Opposite ends 40*a* and 40*b* of body portion 40 of the carriage are provided with circular openings 58 which receive support and guide posts 16 as set forth hereinafter, and circular openings 60 are provided inwardly of each of the openings 58 for receiving the lift screws of lift screw units 18 as set forth more fully hereinafter. Openings 58 are on diametrically opposite sides of the opening provided in carriage 14 by recess 54 and arcuate surface 56 and, likewise, openings 60 are on diametrically opposite sides of the carriage opening. Each of the openings 58 has a post axis 58*a*, and each of the screw openings 60 has a screw axis 60*a*, and axes 58*a*, 60*a* and A are coplanar with respect to a vertical plane P through the carriage.

Preferably, the body portion and clamping plate of carriage 14 are of aluminum, and the carriage has an axial thickness of two inches. Further, as best seen in FIGS. 1 and 2, the carriage includes oil impregnated bronze bearing sleeves 62 which are press fit or otherwise secured in openings 58 to sidably receive support and guide posts 16. The carriage further includes cast bronze bearing sleeves 64, which are internally threaded for threaded interengagement with the lift screws of lift screw units 18, and which are received in openings 60 in the carriage and retained in the latter against rotation relative to the carriage by roll pins 66, or the like, inserted through pin openings 68 which extend through body portion 40 of the carriage and intercept a peripheral edge of openings 60, as shown in FIG. 7. Alternatively, the retention of sleeves 64 can be obtained by set screws extending radially into engagement with the sleeves through threaded bores in the body portion.

Figure 3:
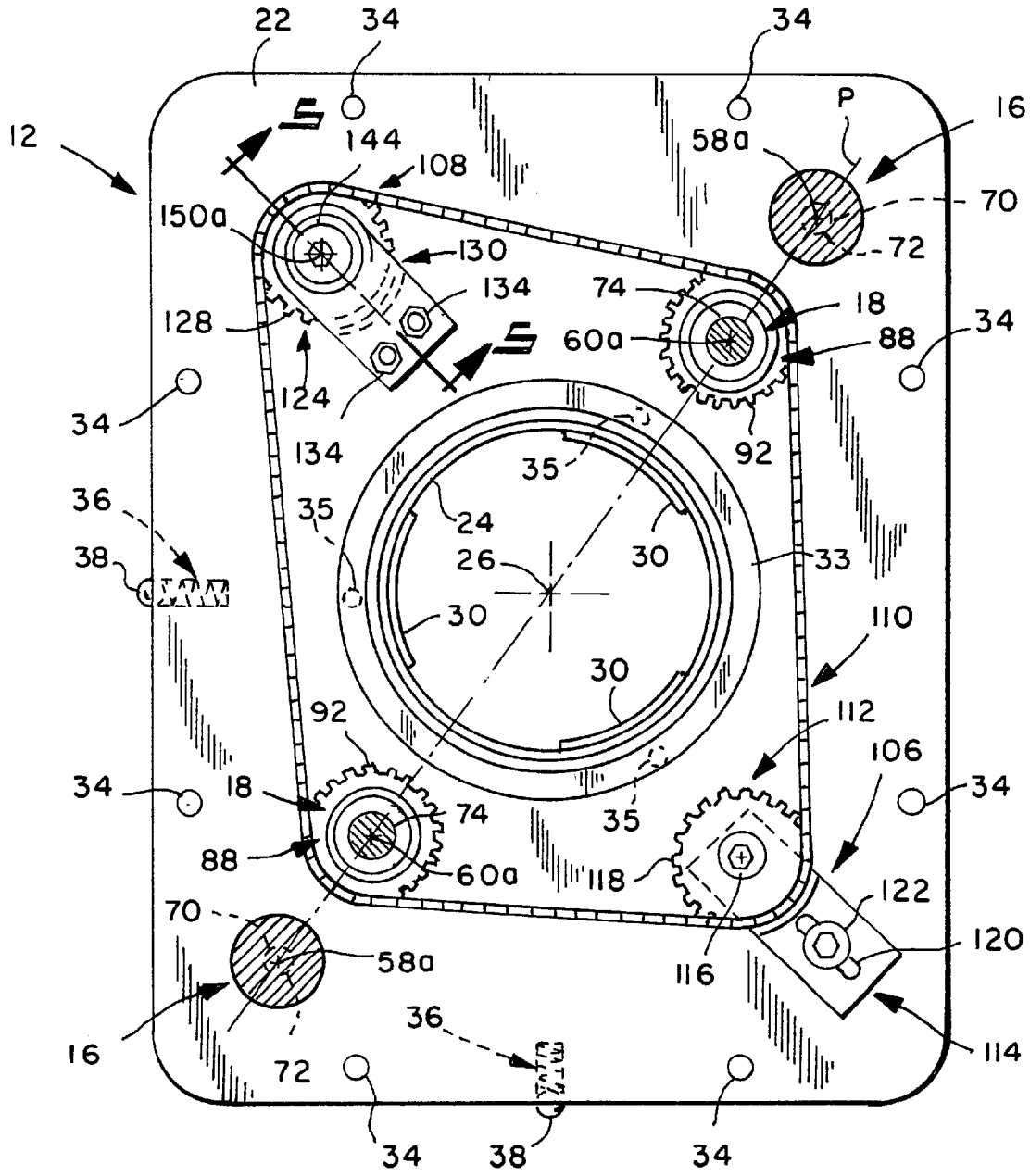
FIG. 3 is a plan view, partially in section, of the bottom side of the support mechanism and showing the drive train for the lift screws.

As will be appreciated from FIGS. 1–3 of the drawing, support and guide posts 16, which preferably are of steel, are secured to bottom side 22 of table plate 12 by means of corresponding socket head cap screws 70 extending through openings therefor in plate 12, not designated numerically, and into threaded engagement with threaded bores 72 provided therefor in the upper ends of the posts. As will be appreciated from FIGS. 1-4, each of the lift or adjusting screw units 18 is mounted on table plate 12 for rotation relative thereto about the corresponding screw axis 60*a*. More particularly in this respect, each of the lift screw units 18 includes a threaded lift screw member 74, preferably of stainless steel, having its upper end threadedly received in a cap member 76. Cap member 76 is T-shaped in cross section and includes a radially outwardly extending circumferential flange 78 at its upper end rotatably supported in a circular recess 80 provided therefor in top side 20 of plate 12. Recess 80 includes a central opening 82 through plate 12 which rotatably receives the shank portion 77 of cap member 76 and, preferably, a thrust bearing plate 84 is interposed between flange 78 and the bottom of recess 80. The lift screw unit is axially captured relative to plate 12 by means of a sprocket wheel 86, preferably of aluminum, having a hub portion 88 surrounding shank 77 of cap member 76 and a radially outwardly extending peripheral flange 90 at the lower end thereof having sprocket teeth 92 about the periphery thereof. Preferably, a thrust washer 84 is also interposed between the upper end of hub portion 88 and bottom side 22 of plate 12, and cap member 76 and sprocket wheel 86 are interengaged with screw member 74 for rotation therewith such as by a roll pin 94. A washer 96 and a stop nut 98 engage against the lower ends of the cap member and sprocket wheel for the purpose set forth hereinafter.

Figure 4:
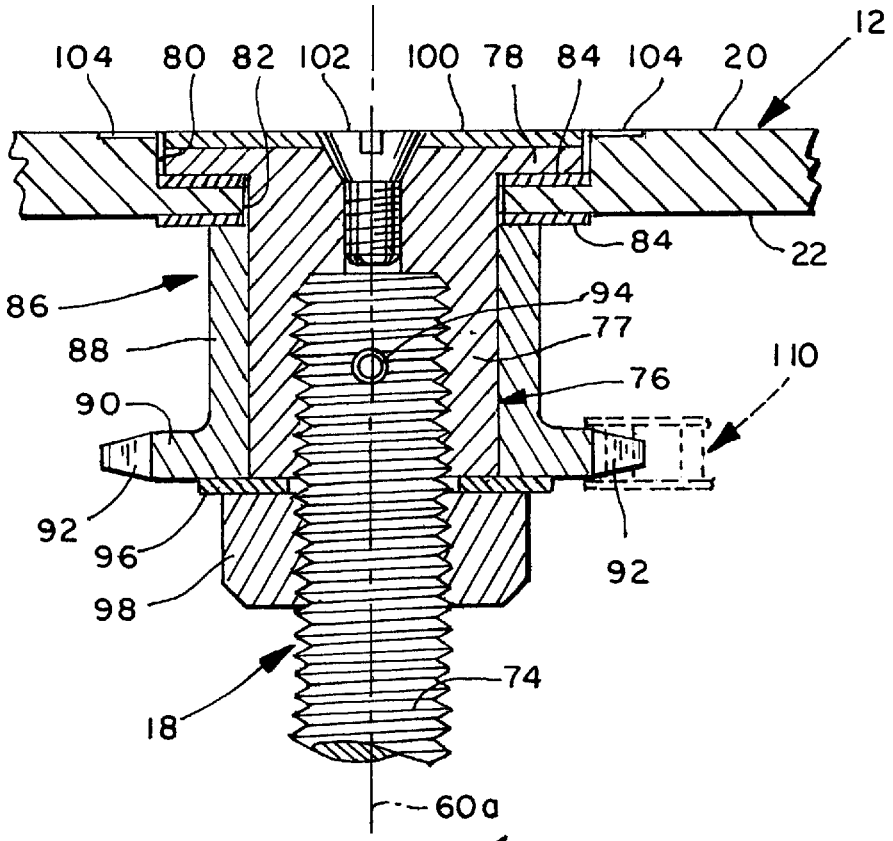
FIG. 4 is an enlarged sectional elevation view of a lift screw component of the mechanism, taken along line 4—4 in FIG. 1.

As best seen in FIGS. 1 and 4, the upper end of each of the lift screw units as defined by flange 78 is exposed at top side 20 of plate 12 and is provided with a scale plate 100 which is fastened thereto for rotation therewith by means of a threaded fastener 102. The outer periphery of each scale plate is provided with graduation marks representing an incremental degree of rotation of the lift screw, and the top side of plate 12 is provided on diametrically opposite sides of recess 80 with fixed reference marks 104 relative to which the incremental markings on the scale plate are displaceable. Preferably, screw member 74 has a ½-32 thread, whereby one revolution of the screw displaces the carriage and thus a router bit thereon 1/32 inch relative to top side 20 of plate 12. The graduation marks on scale plate 100 preferably represent approximately 0.001 inch of displacement. Thus, extremely small and precise adjustments of a router bit relative to top surface 20 is possible. Advantageously, scale plate 100 can be loosened and rotated relative to the screw unit so as to preposition a given mark on the plate with one of the reference marks 104 on the table plate. Preferably too, the incremental indicia on scale plate 100 is in increments of about 0.001 inch, thus enabling extremely precise adjustment of a router bit relative to top side 20 of the table plate. Of further advantage is the fact that the scale plates 100 of the two lift screw units are independently settable relative to the corresponding screw member, whereby the scales can be set for referencing two different zero positions for routing operations that cannot be completed in one pass.

As will be best appreciated from FIGS. 2 and 3 of the drawing, the lift screws are adapted to be simultaneously rotated relative to table plate 12 for adjusting the position of carriage 14 relative thereto by a drive train which includes a sprocket wheel 86 on each of the lift screw members, an idler sprocket wheel unit 106 and a drive sprocket unit 108 mounted on bottom side 22 of plate 12, and an endless sprocket chain 110 which is trained about sprocket wheels 88 and the sprocket wheels of sprocket wheel units 106 and 108 and, preferably, is a steel roller chain. Sprocket units 106 and 108 are on diametrically opposite sides of opening 24 and are circumferentially between the lift screws and, while not diametrically aligned with one another in the embodiment disclosed, could be so aligned. Sprocket wheel unit 106 includes a sprocket wheel 112, preferably of aluminum, rotatably mounted on a sprocket wheel support block 114 by means of a shoulder bolt 116 for rotation about the axis thereof. Sprocket wheel 112 includes teeth 118 for engagement with sprocket chain 110, and support block 114, which is preferably of aluminum, includes an elongated slot 120 therethrough and by which the support block is mounted on the bottom side 22 of plate 12 such as by a socket head cap screw 122. Slot 120 and cap screw 122 provide for adjusting the position of sprocket wheel unit 106 so as to maintain a desired tension on the sprocket chain.

Figure 5:
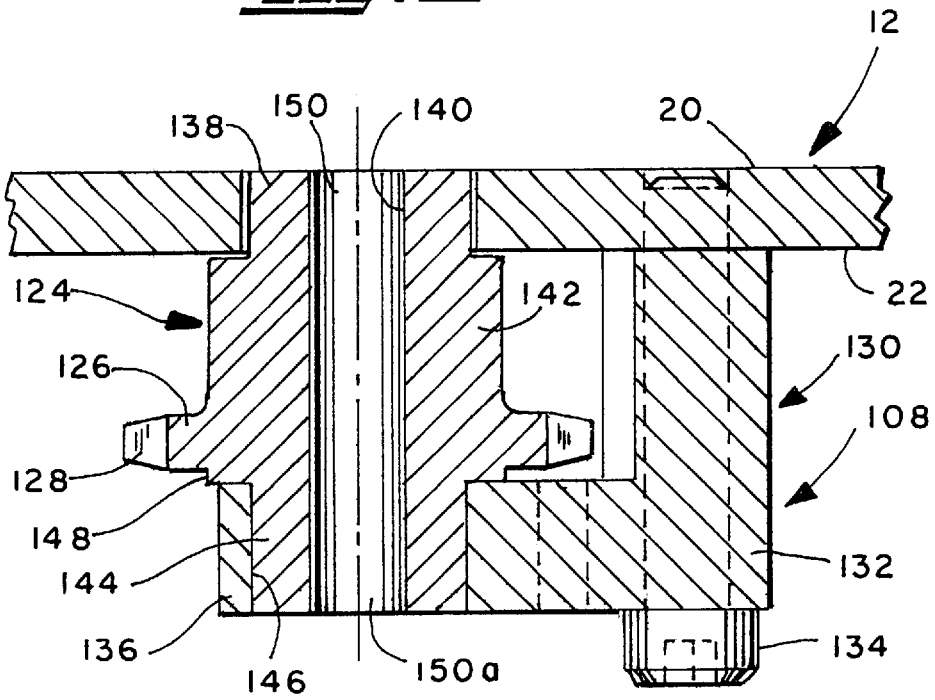
FIG. 5 is an enlarged sectional elevation view of the drivable idler sprocket wheel of the drive train, taken along line 5—5 in FIG. 3.
Figure 6:
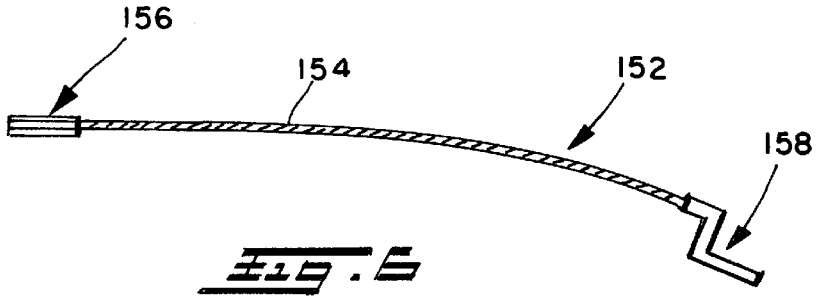
FIG. 6 illustrates a crank-type flexible cable for elevating and lowering the carriage relative to the work supporting surface; and, FIG. 7 is an exploded plan view of the carriage component of the support mechanism.

As will be best appreciated from FIG. 5, drive sprocket unit 108 includes a sprocket wheel 124 of Acetron having a radially outwardly extending peripheral flange 126 between the axially opposite ends thereof and the outer periphery of which is provided with sprocket teeth 128 for engagement with sprocket chain 110. The sprocket wheel is mounted on bottom side 22 of table plate 12 by means of an L-shaped mounting block 130 having a vertical leg portion 132 secured to plate 12 by means of a pair of socket head cap screws 134, and a horizontal leg portion 136 spaced from bottom side 22 and rotatably supporting the lower end of sprocket wheel 124. More particularly in this respect, sprocket wheel 124 includes a circular upper hub portion 138 rotatably received in a circular opening 140 in table plate 12, an intermediate hub portion 142 underlying bottom side 22 of plate 12 between the latter and flange 126, and a lower hub portion including a circular portion 144 rotatably received in a circular opening 146 in leg 136 of mounting member 130. A shoulder portion 148 of the lower hub portion rests on the upper surface of leg 136. The hub portions of sprocket wheel 124 are provided with a hexagonal passageway 150 therethrough between the axially opposite ends thereof and by which the sprocket wheel is adapted to be rotated to drive sprocket chain 110 and, thus, simultaneously rotate lift screw units 18. In accordance with one aspect of the invention, the lower end 150a of passageway 150 is adapted to receive the end of a tool such as flexible drive cable 152 shown in FIG. 6 of the drawing, so as to enable an operator to rotate the lift screw units while observing rotational displacement of scale plates 100 during an adjusting operation. More particularly in this respect, drive cable 152 includes a flexible, helically wound cable member 154 of spring steel having a hexagonal head 156 at one end which is insertable into end 150*a* of passageway 150 and having a crank-like handle 158 at the opposite end for rotating the cable. Thus, it will be appreciated that end 156 can be inserted into the lower end 150*a* of passageway 150 and cable member 154 flexed outwardly and upwardly of table plate 12 and supported by the operator with one hand while the cable member is turned through the use of crank 158 to drive sprocket wheel 124. It will be appreciated too that an appropriate tool can be introduced into the upper end of passageway 150 for rotating the sprocket wheel from the top side of plate 12.

As mentioned hereinabove, stop nuts 98 are provided on lift screw members 74 adjacent the underside of sprocket wheels 86 thereon whereby nuts 98 are between carriage 14 and the underside of table plate 12 and function to stop upward displacement of carriage 14 to preclude engagement thereof with the sprocket wheels and sprocket chain of the drive train. Preferably, the lower ends of screw member 74 are provided with stop nuts 160 which are adapted to engage with and stop downward displacement of carriage 14 to preclude undesired separation of the carriage from the lift screws and guide posts.

While particular emphasis has been placed herein on the preferred embodiment illustrated and described, it will be appreciated that many changes can be made in the preferred embodiment and that other embodiments of the support mechanism can be devised without departing from the principles of the invention. In the respect, for example, the screw units 18 could be diametrically opposed to one another and offset 90° from the preferred coplanar relationship with post 16, so as to provide the desired balanced suspension and balanced adjustment of the carriage and a router mounted therein. The disclosed arrangement is preferred in that the carriage would have to be increased in size, and thus weight, in order to accommodate such a disposition of the lift screws relative to the guide posts. Further, while it is preferred that the drive arrangement include a steel roller chain and sprocket wheels, it will be appreciated that other toothed wheel and drive belt arrangements can be used to achieve the desired simultaneous rotation of the lift screw units. These and other modifications of the preferred embodiment as well as other embodiments of the invention will be obvious and suggested from the foregoing description of the preferred embodiment, whereby it is to be distinctly understood that the descriptive matter herein is to be interpreted merely as illustrative of the invention and not as a limitation.

Having thus described the invention, it is so claimed:

1. A support mechanism for a router having a router axis, comprising a plate having top and bottom sides and an opening therethrough having an opening axis, a carriage beneath said plate for supporting a router coaxial with said opening axis, a pair of guide posts slidably supporting said carriage for axial displacement toward and away from said plate, and a of adjusting screws rotatable relative to said plate and interengaging with said carriage for rotation of said screws to displace said carriage relative to said plate, each of said guide posts having a post axis, each of said adjusting screws having a screw axis, the axes of the posts being coplanar with said opening axis, and the axes of the adjusting screws being coplanar with said opening axis.

2. A mechanism according to claim 1, wherein said adjusting screws are between said pair of guide posts.

3. A mechanism according to claim 1, wherein said opening axis is coplanar with the post and adjusting screw axes.

4. A mechanism according to claim 1, wherein at least one of said adjusting screws has an end exposed at said top side of said plate, and an indica plate on said end for indicating the axial position of said carriage relative to said plate.

5. A mechanism according to claim 4, wherein said indicia plate is settable relative to said one adjusting screw and a reference mark on said top side of said plate.

6. A mechanism according to claim 1, wherein each of the adjusting screws has an end exposed at said top side of said plate, and an indicia plate on the end of each screw for indicating the axial position of said carriage relative to said plate.

7. A mechanism according to claim 6, wherein each of the indicia plates is settable relative to the corresponding adjusting screw and a corresponding reference mark on said top side of said plate.

8. A mechanism according to claim 7, wherein said first and second adjusting screws are between said pair of guide posts.

9. A mechanism according to claim 8, wherein said opening axis is coplanar with the post and adjusting screw axes.

10. A support mechanism for a router having a router axis, comprising a plate having top and bottom sides and an opening therethrough having an opening axis, a carriage beneath said plate for supporting a router coaxial with said opening axis, a pair of guide posts each having a post axis parallel to said opening axis, said guide posts slidably supporting said carriage for axial displacement toward and away from said plate, said guide posts being on diametrically opposite sides of said opening, and a pair of adjusting screws on diametrically opposite sides of said opening, each adjusting screw being rotatable relative to said plate about a corresponding screw axis parallel to said opening axis, and said adjusting screws interengaging with said carriage for rotation of the screws to displace said carriage relative to said plate.

11. A mechanism according to claim 10, wherein the axes of the guide posts and opening are coplanar.

12. A mechanism according to claim 10, wherein the axes of the adjusting screws and opening are coplanar.

13. A mechanism according to claim 10, wherein the axes of the guide posts, adjusting screws and opening are coplanar.

14. A mechanism according to claim 13, wherein the adjusting screws are between the guide posts.

15. A mechanism according to claim 10, wherein each of the adjusting screws has an end exposed at said top side of said plate, and an indicia plate on the end of each screw for indicating the axial position of said carriage relative to said plate.

16. A mechanism according to claim 15, wherein each of the indicia plates is settable relative to the corresponding adjusting screw and a corresponding reference mark on said top of said plate.

17. A mechanism according to claim 10, further including drive means for simultaneously rotating said pair of adjusting screws.

18. A mechanism according to claim 17, wherein said drive means includes means for rotating one of said pair of adjusting screws, and means drivingly interconnecting said one and the other of said pair of adjusting screws for rotation of said one screw to simultaneously rotate the other.

19. A mechanism according to claim 18, wherein said means for rotating one of said pair of adjusting screws includes rotatable operating means accessible at the bottom side of said plate.

20. A mechanism according to claim 18, wherein said drive means includes means for rotating the other of said pair of adjusting screws, whereby said means drivingly interconnecting said one and the other of said pair of adjusting screws simultaneously rotates the one adjusting screw.

21. A mechanism according to claim 17, wherein said drive means includes endless belt means interconnecting said pair of adjusting screws.

22. A mechanism according to claim 17, wherein said drive means includes a sprocket wheel on each adjusting screw for rotation therewith, a pair of sprocket wheels on the bottom side of said plate for rotation relative thereto, and endless belt means trained about the sprocket wheels on the adjusting screws and said pair of sprocket wheels.

23. A mechanism according to claim 22, wherein said means for rotating one of said pair of adjusting screws includes one of said pair of sprocket wheels having an end accessible at said top side of said plate for rotating the one sprocket wheel.

24. A mechanism according to claim 22, wherein one of said pair of sprocket wheels is adjustable for tensioning said belt means.

25. A mechanism according to claim 22, wherein said adjusting screws are on diametrically opposite sides of said opening and said idler sprocket wheels are on diametrically opposite sides of said opening and circumferentially between the adjusting screws.

26. A mechanism according to claim 10, wherein the axes of the guide posts are coplanar with said opening axis, the axes of the adjusting screws are coplanar with said opening axis, and drive means for simultaneously rotating said pair of adjusting screws.

27. A mechanism according to claim 26, wherein said drive means includes a sprocket wheel on each adjusting screw for rotation therewith, a pair of sprocket wheels on the bottom side of said plate for rotation relative thereto, and endless belt means trained about the sprocket wheels on the adjusting screws and said pair of sprocket wheels.

28. A mechanism according to claim 27, wherein one of said pair of sprocket wheels is adjustable for tensioning said belt means.

29. A mechanism according to claim 27, wherein each of the adjusting screws has an end exposed at said top side of said plate, and an indicia plate on the end of each screw for indicating the axial position of said carriage relative to said plate.

30. A mechanism according to claim 29, wherein each of the indicia plates is settable relative to the corresponding adjusting screw and a corresponding reference mark on said top of said plate.

31. A mechanism according to claim 27, wherein the axes of the guide posts, adjusting screws and opening are coplanar.

32. A mechanism according to claim 31, wherein the adjusting screws are between the guide posts.

33. A mechanism according to claim 32, wherein each of the adjusting screws has an end exposed at said top side of said plate, and an indicia plate on the end of each screw for indicating the axial position of said carriage relative to said plate.

34. A mechanism according to claim 33, wherein each of the indicia plates is settable relative to the corresponding adjusting screw and a corresponding reference mark on said top of said plate.

35. A mechanism according to claim 34, wherein one of said pair of sprocket wheels is adjustable for tensioning said belt means.

36. A mechanism according to claim 34, wherein said means for rotating one of said pair of adjusting screws includes one of said pair of sprocket wheels having an end accessible for rotating the one idler sprocket wheel.

37. A support mechanism for a router having a router axis, comprising a plate having top and bottom sides and an opening therethrough having an opening axis, a carriage beneath said late for supporting a router coaxial with said opening axis, a pair of guide posts on said bottom side slidably supporting said carriage for axial displacement toward and away from said plate, each guide post having a post axis, said carriage comprising a body portion having an arcuate recess therein and a clamp plate removably mounted on said body portion and having an arcuate surface facing said recess when said clamp plate is mounted on said body portion, said recess and arcuate surface providing an opening through said carriage for engaging about a router to be supported by the carriage for displacement therewith, and the opening through said carriage having an axis coplanar with the axes of the guide posts.

38. A mechanism according to claim 37, wherein said body portion has opposite ends, and a post opening through each end for slidably receiving a corresponding one of said guide posts.

39. A mechanism according to claim 37, and at least one adjusting screw supported on said plate for rotation relative thereto and threadedly interengaged with said carriage for rotation of the screw to displace the carriage relative to said plate.

40. A mechanism according to claim 37, and a pair of adjusting screws rotatable relative to said plate and threadedly interengaged with said body portion for rotation of the screws to displace the carriage relative to said plate, and means for simultaneously rotating the adjusting screws.

41. A mechanism according to claim 37, wherein the axis of the opening through said carriage is coaxial with the axis of the opening through said plate.

42. A mechanism according to claim 37, wherein the axes of the guide posts and the opening through said plate are coplanar.

43. A mechanism according to claim 42, wherein the axis of the opening through said carriage is coaxial with the axis of the opening through said plate.

44. A mechanism according to claim 43, and a pair of adjusting screws rotatable relative to said plate and threadedly interengaged with said body portion for rotation of the screws to displace the carriage relative to said plate, and means for simultaneously rotating the adjusting screws.

45. A mechanism according to claim 44, wherein said adjusting screws are on diametrically opposite sides of the opening through said plate.

46. A mechanism according to claim 44, wherein each of the adjusting screws has a screw axis, and the axes of the guide posts and adjusting screws are coplanar.

47. A mechanism according to claim 46, wherein said adjusting screws are between said guide posts.

48. A mechanism according to claim 47, wherein each of the adjusting screws has an end exposed at said top side of said plate, and an indicia plate on the end of each screw for indicating the axial position of said carriage relative to said plate.

49. A mechanism according to claim 48, wherein each of the indicia plates is settable relative to the corresponding adjusting screw and a corresponding reference mark on said top of said plate.

50. A mechanism according to claim 46, further including a sprocket wheel on each adjusting screw for rotation therewith, a pair of sprocket wheels on the bottom side of said plate, and an endless belt trained about the sprocket wheels on the adjusting screws and said pair of sprocket wheels, whereby driving of said belt simultaneously rotates the adjusting screws.

51. A mechanism according to claim 50, wherein one of said pair of sprocket wheels has an end beneath said plate for engaging with a tool for rotating the one sprocket wheel to drive said belt.

52. A mechanism according to claim 51, wherein one of said pair of sprocket wheels is adjustable for tensioning said belt.

* * * * *

UNITED STATES PATENT AND TRADEMARK OFFICE

CERTIFICATE OF CORRECTION

PATENT NO. : 6,505,659 B1
DATED : January 14, 2003
INVENTOR(S) : Hummel

It is certified that error appears in the above-identified patent and that said Letters Patent is hereby corrected as shown below:

Column 8,
Line 8, after “a” insert -- pair --.

Column 10,
Line 27, delete “late” and insert therefor -- plate --.

Signed and Sealed this

Twenty-fifth Day of March, 2003

JAMES E. ROGAN
*Director of the United States Patent and Trademark Office*